United States Patent [19]

Yamaguchi et al.

[11] 3,986,790

[45] Oct. 19, 1976

[54] SINGLE SUCTION TYPE AIR INLET CASING OF AN AXIAL-FLOW COMPRESSOR

[75] Inventors: Nobuyuki Yamaguchi; Makoto Kobayashi, both of Kobe; Sunao Aoki, Takasago, all of Japan

[73] Assignee: Mitsubishi Jukogyo Kabushiki Kaisha, Japan

[22] Filed: May 28, 1975

[21] Appl. No.: 581,478

[30] Foreign Application Priority Data

May 31, 1974 Japan ..... 49-63524[U]

[52] U.S. Cl. ..... 415/182; 415/219 R

[51] Int. Cl.[2] ..... F04D 29/44; F01D 9/06

[58] Field of Search ..... 415/182, 219 R; 137/15.1; 138/37, 39

[56] References Cited

UNITED STATES PATENTS

| | | | |
|---|---|---|---|
| 820,399 | 5/1906 | Davidison | 415/182 |
| 2,646,211 | 7/1953 | Isabella | 137/15.1 |
| 3,894,302 | 7/1975 | Lasater | 138/39 |
| 3,910,715 | 10/1975 | Yedidian | 415/182 |

FOREIGN PATENTS OR APPLICATIONS

| | | | |
|---|---|---|---|
| 1,503,270 | 7/1969 | Germany | 415/182 |
| 1,528,691 | 10/1969 | Germany | |

*Primary Examiner*—Henry F. Raduazo
*Attorney, Agent, or Firm*—McGlew and Tuttle

[57] ABSTRACT

A single suction type air inlet casing of an axial-flow compressor, characterized in that an inner cylinder of the single suction type air inlet casing is shaped in an elliptical section having its major axis in the air inlet direction and said elliptical section is made to diminish in size toward the inlet of the axial-flow compressor.

4 Claims, 14 Drawing Figures

SINGLE SUCTION TYPE AIR INLET CASING OF AN AXIAL-FLOW COMPRESSOR

The present invention relates to a single suction type air inlet casing of an axial-flow compressor in which a flow of air current from the air inlet casing to the axial-flow compressor is improved.

A conventional single suction type air inlet casing used in an axial-flow compressor will be described with reference to FIG. 1 and FIG. 2. FIG. 1 shows a longitudinally sectional view taken along the axis of the axial-flow compressor and FIG. 2 is a sectional view taken along the line II—II of FIG. 1

When an air current 03 sucked from a casing intake port 02 of an air inlet casing 01 mounted on an axial-flow compressor passes through a large trumpet-shaped, inner cylinder 04, a large separation area is caused to generate at the opposite side to the intake port 02 about the inner cylinder 04. Because of said separation area, turbulence of the air current grows violent, the pressure loss of the air inlet casing is increased and the unevenness of a flow in the compressor inlet is enlarged so that the performance of the compressor is lowered. This compressor is used, for example, in such a manner as shown in FIG. 3 to FIG. 5, in which the reference numeral 05 represents an outlet casing, 06 : irregular tube, 07 : flow-uniforming lattice, 08 : Venturi and 09 : outlet part duct.

Since an axial-flow compressor has, in general, such a composition that the shaft thereof 010 is supported outside the air inlet casing 01, it is required that the inner cylinder 04 has a large, trumpet-shaped, forward expanse (in the reverse direction to the compressor) under the influence of a bearing 011, piping and likes. Although this inner cylinder has, hitherto, been made in a simple way for meeting this requirement and from the convenience of its manufacture, it has been required, for improving the performance of an axial-flow compressor, that said inner cylinder is hydraulically taken into consideration to seek the improvements in a flow pattern in the air inlet casing.

It is an object of the present invention to eliminate the above defects and to improve a flow of air current from an air inlet casing to an axial-flow compressor so that the performance of said axial-flow compressor is prevented from lowering. According to the present invention, a single suction type air inlet casing of an axial-flow compressor is provided which is characterized in that an inner cylinder of the single suction type air inlet casing is shaped in an elliptical section having its major axis in the air inlet direction and said elliptical section is made to diminish in size toward the inlet of the axial-flow compressor, or a trigonopyramidal tail which diminishes in size approachingly toward the axial-flow compressor inlet is fixed on the air inlet direction rear part of said inner cylinder.

The present invention will be described hereinafter with reference to embodiments shown in the accompanying drawings.

FIG. 1 to FIG. 5 relate to a conventional example.

FIG. 6 to FIG. 14 relate to the present invention.

Figure 1:
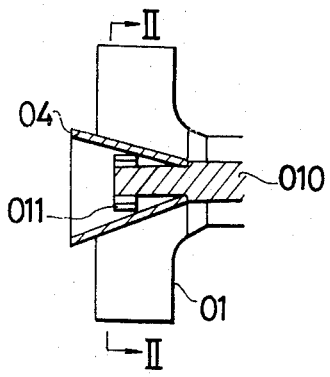
FIG. 1 is a sectional view taken along the line I—I of FIG. 2.
Figure 2:
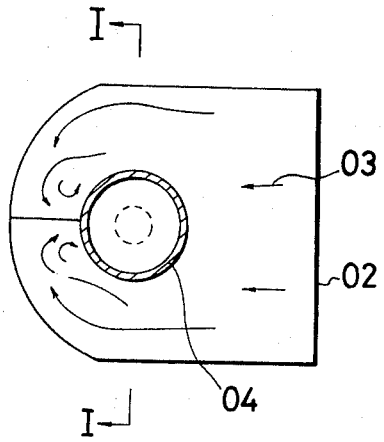
FIG. 2 is a sectional view taken along the line II—II of FIG. 1.
Figure 3:
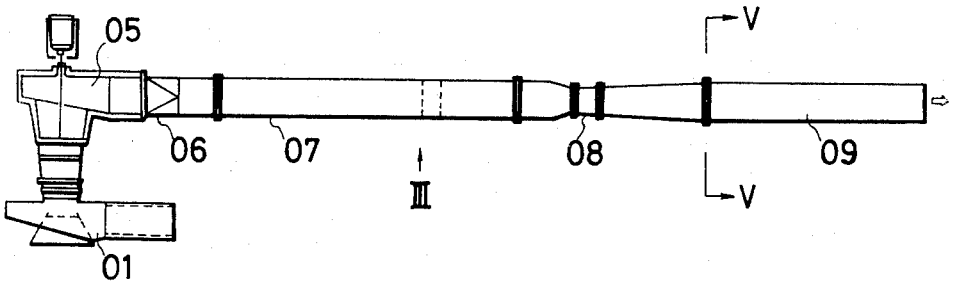
FIG. 3 is a plane view showing an embodiment.
Figure 4:
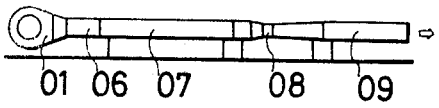
FIG. 4 is a front view of FIG. 3 observed from the direction III.
Figure 5:
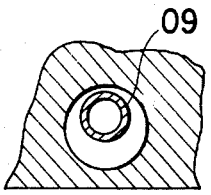
FIG. 5 is a sectional view taken along the line V—V of FIG. 3.
Figure 6:
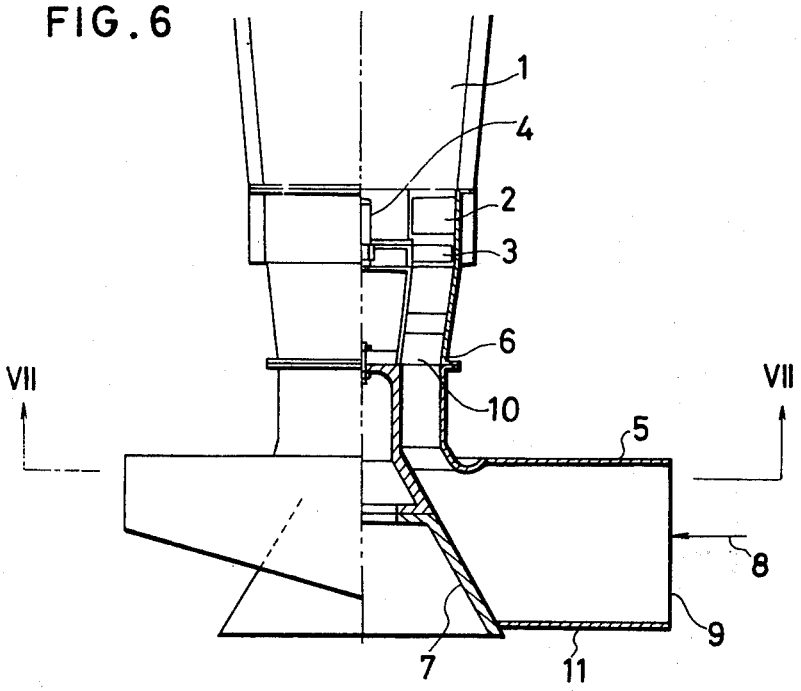

FIG. 6 is a sectional view showing one embodiment in which the invention is applied to an axial-flow compressor.

Figure 7:
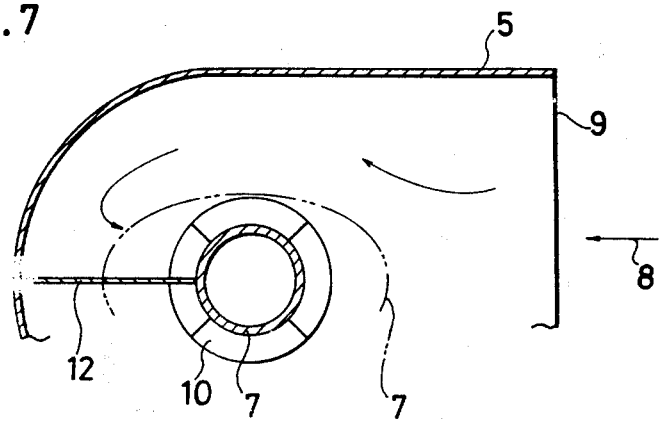

FIG. 7 is a sectional view taken along the line VII—VII of FIG. 6.

Figure 8:
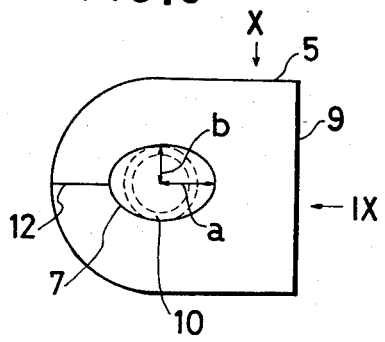

FIG. 8 is an illustrative view showing the relationship between the major axis *a* and the minor axis *b* in a case the inner cylinder is cut.

Figure 9:
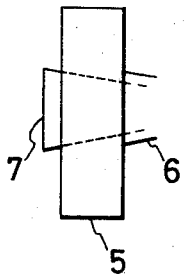

FIG. 9 is a side view of FIG. 8 observed from the direction IX.

Figure 10:
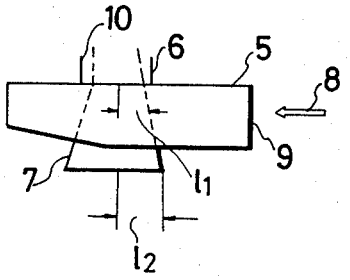

FIG. 10 is a plane view of FIG. 8 observed from the direction X.

Figure 11:
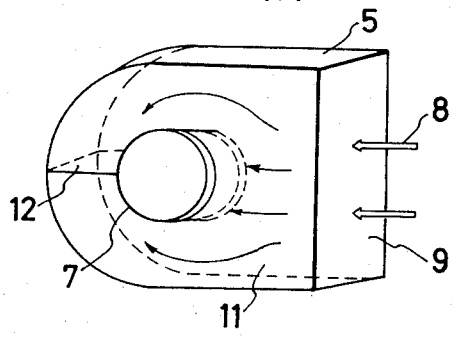

FIG. 11 is an oblique view of the casing.

Figure 12:
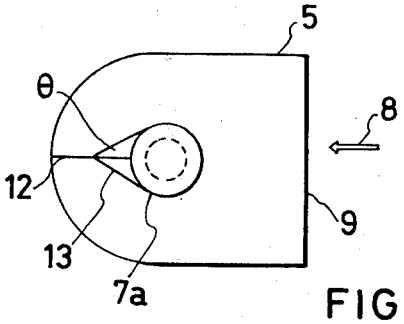

FIG. 12 is an illustrative view showing another embodiment in which the tail is fixed.

Figure 13:
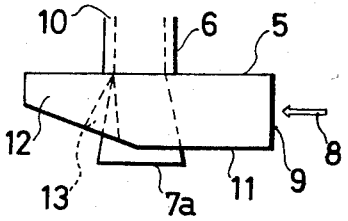

FIG. 13 is a plane view of FIG. 12.

Figure 14:
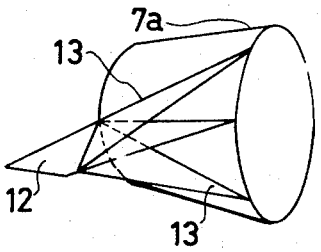

FIG. 14. is an oblique view for illustrating the tail.

FIG. 6 to FIG. 14 illustrate the present invention applied to a single suction type air inlet casing of an axial-flow compressor. The reference numeral 1 represents an axial-flow compressor, 2 : stationary blade, 3 : compressor movable blade which is rotated together with a shaft 4 of the compressor 1. The reference numeral 5 is a single suction type air inlet casing mounted on a compressor inlet 6 of the compressor 1 and the reference numeral 7 is an inner cylinder of the air inlet casing 5, of which the sectional form cut in a plane normal to its axis is of an elliptical section of the streamline shape. The major axis of said ellipse is in the air inlet direction (a direction in that the air current 8 is sucked from an intake port 9 of the casing 5). Said inner cylinder 7 is so shaped that said elliptical section diminishes in size linearly toward said compressor inlet 6 side. The compressor side end part of said inner cylinder 7 is shaped in a cylindrical form concentric with the inlet 6 inside the inlet 6. An annular gap 10 between said inner cylinder 7 and inlet 6 leads to said movable blade 3. This point will be described in more detail with reference to FIG. 8 and FIG. 10. The sectional form of said inner cylinder 7 is of an ellipse having a minor radius *b* as the minimum radius required in that section. The major radius *a* of said ellipse is diminishing $l_2 \rightarrow l_1$, for example linearly from the front 11 of said casing 5 to the compressor inlet 6, wherein the designation $l_1$ is a radius of the inner cylinder and $l_2$ may be properly set to obtain a preferable flow. The reference numeral 12 represents a dashboard partitioning between the inner cylinder 7 and casing 5, which is fitted on the opposite side to the casing intake port 9 of the inner cylinder 7, for maintaining the vertical symmetry of a flow pattern in the casing 5 as shown in FIG. 7 and FIG. 11, so that aggravation of the flow pattern due to an inner cylinder rear current can be reduced.

Since a flow coming round into the inner cylinder 7 is coming round more smoothly as compared with a columnar or conical inner cylinder when the air current 8 is sucked into the casing through the intake port 9 by driving the compressor 1, the extent of the separation area from the surface of the inner cylinder 7 at the rear part becomes narrow extremely in comparison with the columnar or conical inner cylinder. Therefore, the flow pattern in the casing at the opposite side to the intake port 9 about the inner cylinder 7 is improved with ensuring the inflow of a uniform flow into the annular gap 10 constituting a compressor flow passage. The pressure loss in the air inlet casing 5 is also lowered because of a sharp reduction of the separation area. As a result, an annulus inlet flow in the compressor flow passage including the annular gap 10 becomes good and an inlet distortion (a full pressure uneven flow at the compressor inlet) is reduced, whereby lowering of the performance of the compressor can be avoided. In many conventional cases the inflow state of the air current 8 at the intake port is in the accompany of a drift and contraction a little, the separation area due to the inner cylinder undergoes an influence. According to the present invention, however, the flow pattern even in an off-designed inflow state caused by a drift and contraction can be improved. In this point of view, the performance of the compressor can be prevented from lowering.

Another embodiment is illustrated in FIG. 12 to FIG. 14, wherein a casing 5, inlet 6, air current 8, intake port 9, annular gap 10, front 11 and dashboard 12 have the same function as those shown in FIG. 6 to FIG. 11.

The reference numeral 7*a* represents the same, trumpet-shaped inner cylinder as one conventionally used alone, of which the compressor side end part is shaped in a cylindrical form concentric with the inlet 6. The reference numeral 13 is a trigonopyramidal tail fixed on the inner cylinder 7*a* at the air inlet direction rear part thereof opposite to the intake port 9. Said tail 13 diminishes in size approachingly from the front 11 side of said casing 5 to the compressor inlet 6 and vanishes at said inlet 6. In addition, the angular aperture $\theta$ of the tail 13 to the inner cylinder 7*a* may be optionally decided in accordance with the form of the casing 5 or likes. Thus, by fixing the trigonopyramidal tail onto the trumpet-shaped inner cylinder 7*a* at the air inlet direction rear part thereof opposite to the intake port 9, the separation area due to the inner cylinder 7*a* can be reduced or extinguished as well as the foregoing case. Moreover, said tail 13 serves to accelerate a flow into the compressor inlet opposite to the intake port 9 in relation with the inner cylinder 7*a*, and as a result, lowering of the full pressure in that range can be avoided. This tail 13 may be easily prepared merely by fitting two plates on the dashboard 12 and trumpet-shaped inner cylinder 7*a* and its manufacture is easy.

According to the present invention, thus, an inner cylinder of a single suction type air inlet casing is shaped in an elliptical section having its major axis in the air inlet direction and said elliptical section is made up to diminish in size toward the compressor inlet, or a trigonopyramidal tail which diminishes in size approachingly toward the compressor inlet is fixed on the air inlet direction rear part of said inner cylinder, whereby a flow of air current at the compressor inlet is improved and lowering of the performance of the compressor can be avoided.

The present invention has been described above with reference to the embodiments in which the invention is applied to an axial-flow compressor. However, it will be understood that the present invention is not limited to these embodiments, but can be applied widely to various turbo machines such as centrifugal compressor and turbine of fluid elements simillar thereto.

What is claimed is:

1. An axial flow compressor, comprising a tubular compressor casing, a compressor shaft rotatably supported in said casing and having a movable blade affixed thereto for rotation therewith, fixed blade means in said casing cooperating with said movable blades and defining with said housing and said movable blades an annular axially extending gas flow path, said casing including a compressor inlet part having an inner cylindrical portion of uniform diameter secured centrally within said casing in axial alignment and concentrically disposed in respect to said shaft, an outer inlet casing part of cylindrical form positioned over said inner part and concentrically arranged therewith and defining with said inner part an annular inlet flow path connecting with the gas flow path, said inner cylindrical part having an outwardly flaring portion extending in a direction away from said shaft, said outer casing part having an axially extending inlet portion and a semi-cylindrical portion to which it is tangent on each side overlying said outwardly flaring part and a tail portion connected to the periphery of said outwardly flaring part and convergent inwardly to a central point on the opposite side of said outwardly flaring part from said inlet and being tapered axially toward said inner cylindrical portion.

2. An axial flow compressor according to claim 1, wherein said tail comprises an elliptical formation of the outwardly flaring part on at least the side opposite to said inlet.

3. An axial flow compressor according to claim 2, wherein said tail comprises an elliptically formed portion extending on each side of said outwardly flaring portion and having a major axis along the axis of said inlet.

4. An axial flow compressor according to claim 1, wherein said tail comprises a trigonopyramidal tail extending from respective diametrically opposite points of said outwardly flaring portion and an inward taper to the central axis of said inlet.

* * * * *